United States Patent [19]

Payne

[11] Patent Number: 5,060,835

[45] Date of Patent: Oct. 29, 1991

[54] BELT TYPE PERSONAL CARRIER APPARATUS FOR CONVENIENTLY SUPPORTING A BEVERAGE CONTAINER AND OTHER BELONGINGS OF A PERSON ABOUT THE PERSON'S WAIST

[76] Inventor: Osamu M. Payne, 329 Desmond Dr., Fayetteville, N.C. 28304

[21] Appl. No.: 559,656

[22] Filed: Jul. 30, 1990

[51] Int. Cl.[5] ..... A45F 5/00

[52] U.S. Cl. ..... 224/224; 224/148; 224/250

[58] Field of Search ..... 224/224, 226, 250, 253, 224/254, 148, 225; 222/175

[56] References Cited

U.S. PATENT DOCUMENTS

| | | | |
|---|---|---|---|
| 417,220 | 12/1889 | Bell | 224/148 |
| 874,945 | 12/1907 | Davey | 224/148 |
| 1,605,195 | 11/1926 | Lewis | 224/148 |
| 3,158,300 | 11/1964 | Withee | 224/253 |
| 3,891,174 | 6/1975 | Harvey | 224/250 |
| 4,018,371 | 4/1977 | George | 224/148 |
| 4,420,104 | 12/1983 | DiIenno | 224/250 |
| 4,545,414 | 10/1985 | Baum | 150/525 |
| 4,548,375 | 10/1985 | Moss | 224/253 |
| 4,676,419 | 6/1987 | Victor | 224/253 |
| 4,754,903 | 7/1988 | Dennis | 224/148 |
| 4,923,105 | 5/1990 | Snyder | 224/253 |

*Primary Examiner*—Renee S. Luebke

*Attorney, Agent, or Firm*—Irving M. Weiner; Joseph P. Carrier; Pamela S. Burt

[57] ABSTRACT

The present invention discloses a carrier apparatus comprising an adjustable belt adapted to be secured about a persons's waist, a reusable beverage container, an elastic harness fixed to the belt and adapted to selectively secure the beverage container therein, and a storage receptacle fixed to the belt in spaced relation to the elastic harness and adapted to securely enclose small articles therein.

16 Claims, 1 Drawing Sheet

BELT TYPE PERSONAL CARRIER APPARATUS FOR CONVENIENTLY SUPPORTING A BEVERAGE CONTAINER AND OTHER BELONGINGS OF A PERSON ABOUT THE PERSON'S WAIST

BACKGROUND OF THE INVENTION

1. Field of the Invention

The invention relates to a belt apparatus adapted to be secured around a person's waist for conveniently supporting and transporting a beverage container, as well as other belongings of the person. Particularly, the invention pertains to such a belt apparatus which can be comfortably, adjustably secured around the person's waist and which integrally includes a beverage container support and a storage receptacle for other belongings of the person.

2. Description of the Relevant Art

In the art there are known carrying devices which are designed to ease the burden of utilizing one's hands in the way of holding objects which, when the devices are employed, allow for the convenience of having hands-free movement. The existing devices are exemplified by the following.

Dennis U.S. Pat. No. 4,754,903 discloses a disposable soft drink carrier adapted to be worn around the neck of a user. The Dennis carrier is designed to extend up and over a person's shoulders and then be fastened around the person's neck, and to support a soft drink such that it freely rests against the user's chest.

Baum U.S. Pat. No. 4,545,414 discloses a camera bag for field use by photographers which is equipped with waist support straps so that the bag having camera equipment disposed therein can be supported about a person's waist allowing for free use of the person's hands in manipulating the camera equipment. The bag also provides a zippered cover flap, within which the waist straps may be contained when not in use.

Lewis U.S. Pat. No. 1,605,195 relates to improvements in belt supported carriers for flasks, and is intended primarily to carry a miner's carbide flask in such a manner that the latter is selectively pivotable as supported on the belt.

George U.S. Pat. No. 4,018,371 discloses a belt device designed in particular to support cold beverage containers, such as beverage cans, about a person's waist and includes insulated receptacles for maintaining the beverage containers in a refrigerated state.

Bell U.S. Pat. No. 417,220 discloses a device for carrying cans of oil or the like in the manner of saddle bags on a horse or other pack animal. The device includes a pair of fluid-tight containers and a harness with strap-and-buckle type supports at opposite ends thereof and which are adapted to securely support the containers, respectively.

The above can known carrying devices have many disadvantages, some of which are as follows.

The Dennis U.S. Pat. No. 4,754,903 allows a beverage container to be supported around a person's neck, but only with constant swinging and bouncing movements whenever the person is moving.

Although the Baum design for a camera carrying device uses a belt-like strap for being secured about a person's waist, the carrying pack itself is rather large and cumbersome so that it would be uncomfortable to wear and highly limit a person's movement, especially when a camera or other equipment is disposed therein.

The Lewis flask carrier has limited applicability because it supports only a single flask in a pivotable manner, and the carrier is not otherwise intended for permitting the flask to be readily moved therefrom (such as to permit a user to take a drink therefrom).

The George beverage belt, like Baum's camera bag, is rather bulky so that it would be uncomfortable to wear and substantially limit a person's movement.

The device disclosed by Bell is not intended to be worn by a person, and it is otherwise inconvenient to remove the containers from the strap-and-buckle type supports.

Known carrying devices, including those discussed above, have as a whole failed to fulfill a need in the art for a simple carrying device which can be comfortably and conveniently worn by an active person for securely supporting a beverage container and a storage receptacle such that the container and receptacle will be conveniently accessible to the person, but will not significantly interfere with the person's movements, even if the movements are relatively vigorous.

SUMMARY OF THE INVENTION

The present invention has been developed to overcome the many limitations and disadvantages of known carrying devices, and to specifically satisfy the above-discussed need in the art.

According to the present invention there is provided a carrier apparatus comprising belt means for being secured about a person's waist, means for readily securing a beverage container to the belt means without fasteners, and receptacle means for securely enclosing small articles such as keys, money, candy, glasses, and other personal belongings therein. The securing means and the receptacle means are connected to the belt means as an integral unit, and are arranged in spaced relation so that they will be disposed opposite to each other when the belt means is secured about a person's waist. Preferably, the belt means will be adjustable so that it can be comfortably worn by different sized persons, while the securing means will comprise an elastic harness which is adapted to securely grip a lower portion of a beverage container, and the receptacle means will include a zipper or other closure means. Also, a squeeze-type beverage container with a discharge nozzle will be provided with the carrier apparatus.

An important object of the present invention is to provide a beverage carrier for active persons which can be conveniently and comfortably worn around the waist of such persons.

Another object of the present invention is to provide such a beverage carrier which also integrally includes a convenient storage receptacle for small personal belongings such as keys, money, glasses, candy, etc.

A further object of the invention is to provide such a beverage carrier which includes an adjustable belt means so that the carrier can be properly utilized by different sized persons.

It is yet another object of the present invention to provide such a beverage carrier in combination with a squeeze-type beverage container which can be readily manipulated between a secured position on the beverage carrier or in a grasped position in a person's hand so that the person can take a drink therefrom, and which includes a nozzle for permitting beverages to be forcibly discharged therethrough when the container is squeezed, and a cap which is adapted to be selectively secured over a discharge end of the nozzle to prevent unwanted spillage.

Still another object of the present invention is to provide such a beverage carrier which has an attractive appearance.

Other objects, advantages and salient features of the present invention will become apparent from the following detailed description which, when taken into conjunction with the annexed drawings, discloses a preferred embodiment of the present invention.

DETAILED DESCRIPTION OF THE PREFERRED EMBODIMENT

Figure 1:
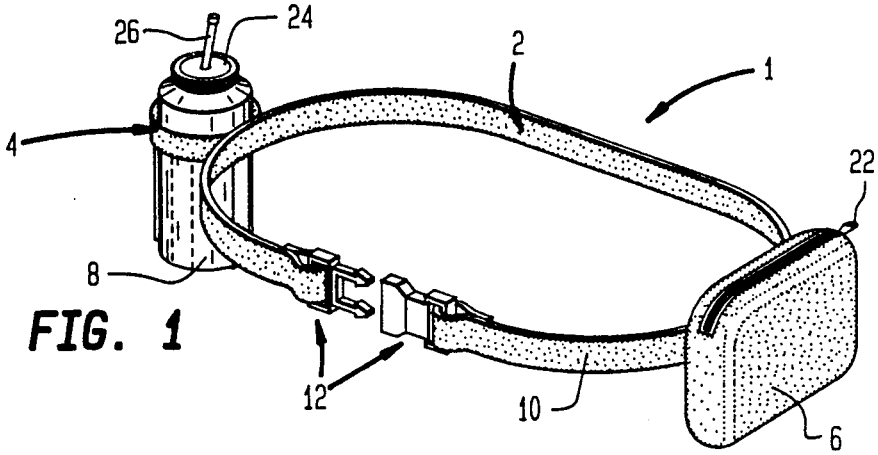
FIG. 1 is a front perspective view of the carrier apparatus together with a squeeze bottle according to a preferred embodiment of the present invention.

Referring to FIGS. 1–5 there is shown a belt apparatus according to a preferred embodiment of the invention and generally indicated at 1. The belt apparatus 1 comprises four primary components, a belt 2, a beverage container securing means 4, a storage receptacle 6 and a beverage container 8. The beverage container securing means 4 and the storage receptacle 6 are fixed to the belt 2 so as to form an integral unit therewith. Also, the securing means 4 and the storage receptacle 6 are preferably positioned in spaced relation along the belt 2 such that they will be disposed opposite to each other and adjacent to a person's hips, respectively, when the belt apparatus 1 is worn by a person so that the weight of the beverage container 8 will be balanced by the weight of the storage receptacle and of articles stored therein.

Figure 2:
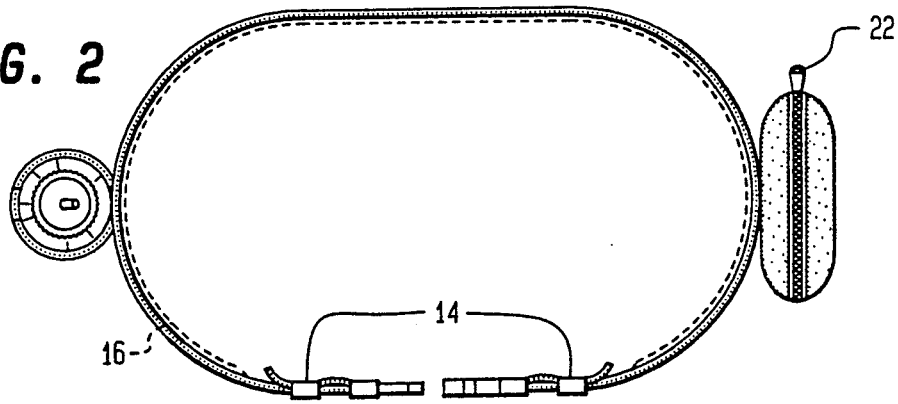
FIG. 2 is a top plan view of FIG. 1.
Figure 3:
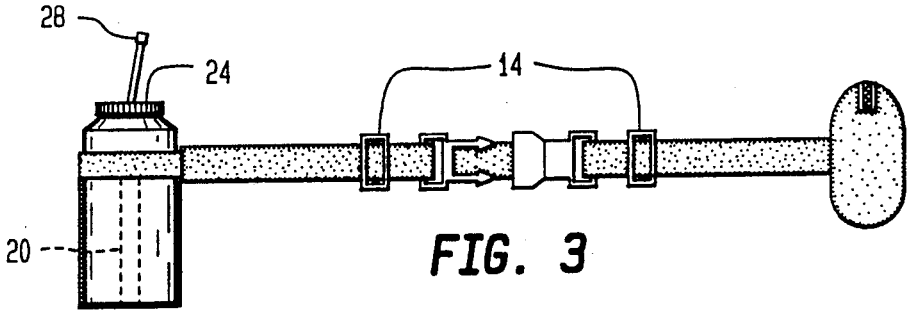
FIG. 3 is a front elevational view of FIG. 1.
Figure 4:
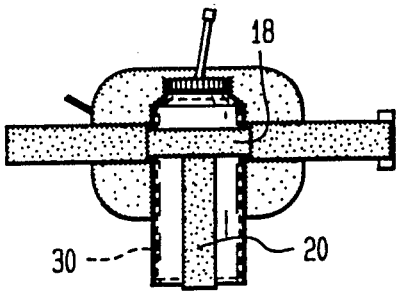
FIG. 4 is a left side elevational view of FIG. 1.
Figure 5:
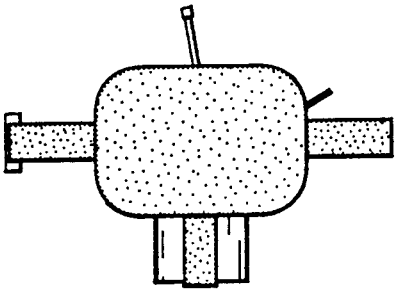
FIG. 5 is a right side elevational view of FIG. 1.

The belt 2 comprises a strap member 10 constructed of any appropriate material such as leather, nylon fabric, propylene fabric, etc., a fastener 12 and a length adjustment means 14 as shown in FIGS. 2 and 3. The fastener 12 will preferably comprise a plastic snap-fit type fastener as depicted, but may comprise any other appropriate fastener such as a buckle, buttons, Velcro brand hook and loop fasteners, etc. Optionally, the belt 2 may also include a padding layer 16 such as indicated by the dotted lines in FIG. 2 to minimize any discomfort to a person wearing the belt apparatus 1.

The beverage container securing means 4 preferably comprises a pair of elastic straps 18, 20. The first strap 18 is a band which is adapted to be tightly fitted about a periphery of the beverage container 8 such that the strap 18 will extend coaxially with the beverage container 8, while the second strap 20 has opposite ends depending perpendicularly from the first strap and is adapted to be tightly fitted about a lower portion of the container 8. The straps 18, 20 are preferably constructed of an elastic material so that they can reliably and easily grip different sized containers by simply sliding the container into the straps, while similarly the containers can be simply removed from the securing means by pulling upwardly on the containers with sufficient force. If desired, a plurality of the second straps 20 could be provided in depending, spaced relation around the first strap 18, as indicated by the phantom lines in FIGS. 1 and 3, while additional bands similar to the first strap 18 could be provided around lower and/or intermediate portions of the second strap 20. Alternatively, the straps 18, 20 could be replaced with a single elastic sock or bag which would completely enclose a lower portion of the container 8. As still another alternative, the straps 18, 20 could have adjustment means, such as Velcro brand hook and loop type fasteners, provided thereon to adjust the length thereof for very tightly gripping the container 8. In the event that such adjustment means are provided on the straps 18, 20, the straps may not be constructed of an elastic material.

The storage receptacle 6 will preferably be made of a lightweight, waterproof material such as a synthetic fabric, and may be constructed of the same material as the belt strap 10. As depicted, the storage receptacle 6 is relatively small in size such that lateral size thereof substantially will not project outwardly of the belt strap 10 when the apparatus one is secured about a person's waist, while the width and the depth of the receptacle 6 are preferably only a few inches each. The internal volume of the receptacle will preferably be in the range of 5–50 cubic inches, and most preferably in the range of 10–25 cubic inches. Thus, the storage receptacle 6 will be large enough to carry many popular personal items, such as keys, a wallet, glasses, money, candy, etc. but is otherwise small enough to avoid interfering with a person's normal active movements when walking, running, biking, etc. The storage receptacle 6 preferably includes a closure means such as the zipper indicated at 22 so that items placed in the receptacle will be securely contained even if a person wearing the belt apparatus 1 is moving vigorously. The storage receptacle 6 effectively functions as a pocket, and is particularly useful for persons wearing exercising clothes without pockets provided therein.

The beverage container 8 is preferably a reusable, squeeze type bottle constructed of flexible materials such as polyethylene or other appropriate polymers. The bottle 8 includes a removable cover 24 having a flexible nozzle 26 provided thereon for permitting beverages to be easily, forcibly discharged therethrough when the container is squeezed, and a cap 28 which is adapted to be selectively secured over a discharge end of the nozzle 26 for preventing beverages in the container 8 from being unintentionally spilled out of the container. Optionally, the container 8 may be insulated, such as by providing a polymer foam insulation layer thereon, as indicated by the dotted line 30 in FIG. 4.

Although there has been described what is at present considered to be the preferred embodiment of the invention, it will be understood that the invention can be embodied in other specific forms without departing from the spirit or essential characteristics thereof. For example, an additional storage receptacle similar to the receptacle 6 could be provided along the belt strap 10 between the beverage container 8 and the storage receptacle 6 such that the second storage receptacle would be disposed opposite to the fastener 12 when the belt apparatus 1 is worn; or a pair of beverage container securing means 4 could be on the belt such that they would be disposed adjacent to a person's hips, respectively, when the belt apparatus is worn and the storage receptacle 6 could be provided between the securing means so as to be disposed opposite to the fastener 12 when the belt apparatus is worn. The present embodiment is, therefore, to be considered in all aspects as illustrative and not restrictive. The scope of the invention is indicated by the appended claims rather than by the foregoing description.

I claim:

1. Belt type personal carrier apparatus comprising:

belt means for being secured exclusively about a person's waist;

means for readily securing a beverage container to the belt means;

receptacle means adapted to selectively enclose small articles therein;

said securing means and said receptacle means being permanently connected to said belt means as an integral unit;

said securing means and said receptacle means being disposed in spaced relation along said belt means such that the securing means and the receptacle means will be disposed opposite to each other and adjacent to a person's hips, respectively, when said belt means is secured about a person's waist;

said securing means comprising a first loop shaped strap adapted to be tightly secured about a beverage container such that the first strap will extend coaxially with a longitudinal axis of the beverage container, and at least one second strap having opposite ends extending perpendicularly from oppositely disposed portions of said first strap, said second strap being adapted to be tightly secured about a lower portion of a container secured by said first strap;

said first and second straps being constructed of an elastic material so that the straps can reliably secure different sized beverage containers; and each of said belt means, said securing means and said receptacle means being constructed of lightweight material.

2. Carrier apparatus according to claim 1, wherein said securing means comprises two of said second straps disposed in spaced relation about said first strap.

3. A carrier apparatus according to claim 1, wherein:

said receptacle means includes a closure means for permitting articles to be placed into the receptacle means and removed therefrom.

4. A carrier apparatus according to claim 3 wherein:

said closure means comprises a zipper.

5. A carrier apparatus according to claim 1, wherein:

said receptacle means has an internal volume in the range of 5–50 cubic inches.

6. A carrier apparatus according to claim 5, wherein:

said receptacle means has an internal volume of 10–25 cubic inches.

7. A carrier apparatus according to claim 1, wherein:

said belt means comprises a quick release fastener and means for readily adjusting the length thereof.

8. A carrier apparatus according to claim 7, wherein:

said belt means further includes a padding layer which is adapted to engage a person's waist when the belt means is secured thereabout.

9. A carrier apparatus according to claim 1, further including:

a beverage container constructed of flexible material.

10. A carrier apparatus according to claim 9, wherein:

said beverage container includes a removable cover means having a nozzle for permitting beverages to be forcibly discharged therethrough when the container is compressed, and having a cap which is adapted to be fitted over a discharge end of the nozzle.

11. A carrier apparatus according to claim 9, wherein:

said beverage container is insulated.

12. Belt type personal carrier apparatus comprising:

an adjustable belt adapted to be exclusively secured about a person's waist;

a reusable beverage container;

an elastic harness permanently fixed to said belt and adapted to secure said beverage container therein; and a storage receptacle permanently fixed to said belt and adapted to securely enclose small articles therein, said storage receptacle and said elastic harness being disposed in spaced relation on said belt such that the elastic harness and the storage receptacle will be disposed opposite to each other and positioned adjacent to a person's hips, respectively, when the belt is secured about the person'waist;

said beverage container being constructed of flexible material;

said elastic harness being adapted to securely grip a lower portion of the beverage container;

said elastic harness including a first loop shaped elastic strap adapted to be tightly fitted about the beverage container such that the first strap extends coaxially with a longitudinal axis of the beverage container, and at least one second strap having opposite ends depending perpendicularly from oppositely disposed portions of said first strap; and said adjustable belt, said reusable container, said elastic harness and said storage receptacle being constructed of lightweight materials.

13. Carrier apparatus according to claim 12, wherein said elastic harness includes two of said second straps disposed in spaced relation about said first strap.

14. A carrier apparatus according to claim 12, wherein said adjustable belt includes a padding layer which is adapted to engage a person's waist when the belt is secured thereabout.

15. A carrier apparatus according to claim 12, wherein:

said storage receptacle has an inner volume in the range of 5–50 cubic inches and includes enclosure means for permitting articles to be placed into the receptacle and removed therefrom.

16. A carrier apparatus according to claim 15, wherein said storage receptacle has an inner volume of 10–25 cubic inches.

* * * * *